US009031267B2

(12) United States Patent
Johnston et al.

(10) Patent No.: US 9,031,267 B2
(45) Date of Patent: May 12, 2015

(54) LOUDSPEAKER ARRAY PROVIDING DIRECT AND INDIRECT RADIATION FROM SAME SET OF DRIVERS

(75) Inventors: James D. Johnston, Redmond, WA (US); Tyler Gleghorn, Renton, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 1322 days.

(21) Appl. No.: 11/847,096

(22) Filed: Aug. 29, 2007

(65) Prior Publication Data

US 2009/0060236 A1 Mar. 5, 2009

(51) Int. Cl.
*H04R 5/02* (2006.01)
*H04R 3/12* (2006.01)

(52) U.S. Cl.
CPC .. *H04R 3/12* (2013.01); *H04R 5/02* (2013.01); *H04R 2205/022* (2013.01)

(58) Field of Classification Search
CPC ..... H04R 3/12; H04R 5/02; H04R 2205/022; H04S 3/00; H04S 1/002
USPC ..... 381/300, 307, 17, 18, 97, 104, 59, 58, 381/98
See application file for complete search history.

(56) References Cited

U.S. PATENT DOCUMENTS 5,109,419 A * 4/1992 Griesinger ..... 381/63
5,301,237 A 4/1994 Fosgate
5,631,964 A * 5/1997 Harada et al. ..... 381/300
5,870,484 A 2/1999 Greenberger
6,628,796 B2 9/2003 Adamson
6,845,163 B1 1/2005 Johnston et al.
7,027,601 B1 * 4/2006 Johnston ..... 381/56
7,076,071 B2 * 7/2006 Katz ..... 381/307
2003/0118194 A1 6/2003 Neumann et al.
2004/0151325 A1 * 8/2004 Hooley et al. ..... 381/18
2004/0218773 A1 11/2004 Andrews
2004/0252849 A1 12/2004 Johnston et al.
2005/0041530 A1 2/2005 Goudie et al.
2005/0201583 A1 9/2005 Colich
2006/0098830 A1 5/2006 Roeder et al.
2006/0153407 A1 7/2006 Keele et al.

(Continued)

FOREIGN PATENT DOCUMENTS

JP 2005197896 A * 7/2005
WO WO 2006009028 A1 * 1/2006
WO WO 2006038380 A1 * 4/2006

OTHER PUBLICATIONS

Boone et al., "On the Applicability of Distributed Mode Loudspeaker Panels for Wave Field Synthesis Based Sound Reproduction," *108th Convention of the AES*, Feb. 19-22, 2000, 9 pages.

(Continued)

*Primary Examiner* — Vivian Chin
*Assistant Examiner* — Con P Tran
(74) *Attorney, Agent, or Firm* — Sandy Swain; Judy Yee; Micky Minhas

(57) ABSTRACT

An array loudspeaker includes a plurality of drivers arranged in an array configuration. A digital signal processor-based control system processes direct audio signal and indirect audio signal inputs for the loudspeaker to simultaneously produce direct sound in the form of a directed beam or wavefront, and indirect sound as a perceptually diffuse soundfield.

16 Claims, 3 Drawing Sheets

(56) References Cited

U.S. PATENT DOCUMENTS

| | | | | |
|---|---|---|---|---|
| 2006/0204022 | A1 | 9/2006 | Hooley et al. | |
| 2006/0280311 | A1 | 12/2006 | Beckinger et al. | |
| 2007/0086606 | A1* | 4/2007 | Goodwin | 381/116 |
| 2007/0165878 | A1* | 7/2007 | Konagai | 381/89 |
| 2007/0217616 | A1* | 9/2007 | Miyazaki | 381/15 |
| 2007/0217621 | A1* | 9/2007 | Takumai | 381/80 |
| 2008/0089522 | A1* | 4/2008 | Baba et al. | 381/17 |
| 2008/0247553 | A1* | 10/2008 | Katayama | 381/17 |
| 2009/0034763 | A1* | 2/2009 | Takumai | 381/300 |

OTHER PUBLICATIONS

"DSP Beam Steering with Modern Line Arrays," Meyer Sound Laboratories Technical Report, 2002, 4 pages.

"Factory Direct: The EAW 760 Revealed," Sep./Oct. 2001 Live Sound International, 8 pages.

Flanagan et al., "Computer-steered microphone arrays for sound transduction in large rooms," J. Acoust. Soc. Am. 78 (5), Nov. 1985, pp. 1508-1518.

"Futurama (or Surround as She is Spoke Today—Part 2)," onhifi.com—Features Archives, http://www.onhifi.com/features/20010615.htm, Jun. 15, 2001, 4 pages.

Hawksford, "Smart directional and diffuse digital loudspeaker arrays," *110th AES Convention*, May 2001, 46 pages.

Kontney, "Steerable Arrays," Sound & Video Contractor, Feb. 2007, 5 pages.

Malham, "Sound Spatialisation," (invited paper) *Proceedings of the First COST-G6 Workshop on Digital Audio Effects* (*DAFX98*), Nov. 1998, pp. 62-70.

Nakayama et al., "Distance control of sound image using line array loudspeaker for three-dimensional audio visual system," pp. 3064-3070.

* cited by examiner

LOUDSPEAKER ARRAY PROVIDING DIRECT AND INDIRECT RADIATION FROM SAME SET OF DRIVERS

BACKGROUND

Since the 1920's, it has been known that the human auditory system treats direct and indirect sound differently in binaural perception. The time difference and delay as well as level difference of direct sound reaching each ear (also known as, interaural time difference and interaural level difference) provide cues that allow the listener to perceive distance and direction from a sound source. Audio typically also contains indirect sound created from repeated reflection and diffraction of sound within a space, which causes diffusion and uniform distribution of sound energy. For example, a diffuse sound field is typical of a gymnasium, swimming pool and interior spaces with many reflecting surfaces and low sound absorption, and also is typical of outdoor locations with sound coming from many directions (such as the canyon effect of an urban street lined with high-rise buildings).

When audio is recorded, both direct and indirect sound typically is captured in the recording. When played back on a conventional loudspeaker system, the hardware makes no attempt to distinguish the direct and indirect sound in the recording. With a very few exceptions, loudspeakers have had fixed ratios of direct-to-indirect radiation that depend on both specific room acoustics and the loudspeaker design. This can create a false perception of distance and direction for the indirect sound played back from a loudspeaker, and conversely fails to provide accurate perceptual cues for direct sound. The conventional loudspeaker system therefore fails to provide a perceptually accurate reproduction of the original audio.

SUMMARY

The following Detailed Description concerns an array loudspeaker that provides direct and indirect sound radiating from a same set of drivers (i.e., electro-acoustic transducers) in an array configuration. The loudspeaker includes a digital signal processor-based (DSP) control system to individually control sound radiated from the drivers. Using beam-forming or steering techniques, a DSP-based control system varies the phase or delay of a direct sound signal radiating from individual drivers of the array to create a directed beam or wavefront. Simultaneously, the control system can cause the driver array to radiate an indirect sound signal in a pattern from the drivers that reduces time waveform and envelope correlation at the ear. This creates a perceptually diffuse sound field, which is characterized by having very low spatial correlation. In this way, the loudspeaker can create any arbitrary combination of directed beams or wavefronts, and indirect sound radiation. For example, the loudspeaker could direct a beam at an individual in the room, a general beam at the whole room, and provide a diffuse, enveloping ambience, simultaneously.

In one implementation, the array can be configured as a linear, uniformly spaced arrangement of drivers. More advantageously, another implementation of the array loudspeaker has the drivers configured as a linear array with octave array spacing. Such configuration as an octave array allows the use of fewer drivers to maintain the same bandwidth relative to a uniform array. The term bandwidth in this context refers to the ratio of frequencies of the direct sound radiation that can be handled with the array. Rather than using all drivers exclusively in a beam-forming operation, various subsets of the octave array drivers at different spacings are used for different bands of frequencies. For example, all drivers may be used to radiate the low frequencies of the direct sound signal, and sets of successively fewer, more-closely spaced drivers to radiate in higher frequency bands. This creates a pseudo-constant beamwidth. Additionally, by dithering the delays of the indirect sound radiated from the drivers, the array can simultaneously create a perceptually diffuse sound field.

This array loudspeaker can be used in a variety of applications to provide a more effective "overlay" of the desired playback acoustics over the actual room acoustics than would be possible using conventional loudspeaker designs. For example, two such array loudspeakers can be paired for a personal (single listener) experience. For such personal reproduction applications, the pair of array loudspeakers can provide an enveloping experience that perceptually recreates the direct and indirect sounds of the original audio environment, without severely limiting listening position or head angle.

For applications involving a larger group of listeners, a number of these array loudspeakers can be arranged in a surround configuration (e.g., a 5, 5.1 or 5.2 surround configuration) to provide a much better sense of inclusion in an auditory environment that better reproduces perception of direct and indirect sounds of the original environment.

In a gaming application, these array loudspeakers arranged in a personal or surround configuration can simply the synthesis of an audio environment containing direct and indirect sound components surrounding the listener(s). With use of such array loudspeakers, the game application is able to vary the direct/indirect ratio in the audio signal from each array loudspeaker, so as to provide direction, distance and depth effects that are much better than those available from conventional direct radiator loudspeaker types.

This Summary is provided to introduce a selection of concepts in a simplified form that is further described below in the Detailed Description. This summary is not intended to identify key features or essential features of the claimed subject matter, nor is it intended to be used as an aid in determining the scope of the claimed subject matter. Additional features and advantages of the invention will be made apparent from the following detailed description of embodiments that proceeds with reference to the accompanying drawings.

DETAILED DESCRIPTION

The following description presents variations of an array loudspeaker that produces direct sound and indirect sound radiated from a same array of drivers. Using digital signal processing techniques, a first or direct audio signal input is processed to radiate as a directed beam from the loudspeaker's driver array. The direct sound signal also can be processed to radiate from the driver array as a directed planar or spherical wavefront. In addition to radiating such direct sound, digital signal processing also is applied to a second or indirect audio signal input to have different phase and amplitude when radiated from each driver of the driver array, so as to be substantially decorrelated in amplitude and envelope at the listener's ears. This creates a soundfield that presents auditory cues that appear as indirect or diffuse sound (i.e., having very low spatial correlation) to the human auditory system. With a set of multiple such array loudspeakers producing direct and indirect sound (e.g., as a stereo pair or surround set arrangement) in a listening room or other space, it is possible to create illusions of depth, distance and direction, with a loudspeaker design that need not occupy a substantial room volume.

Figure 1:
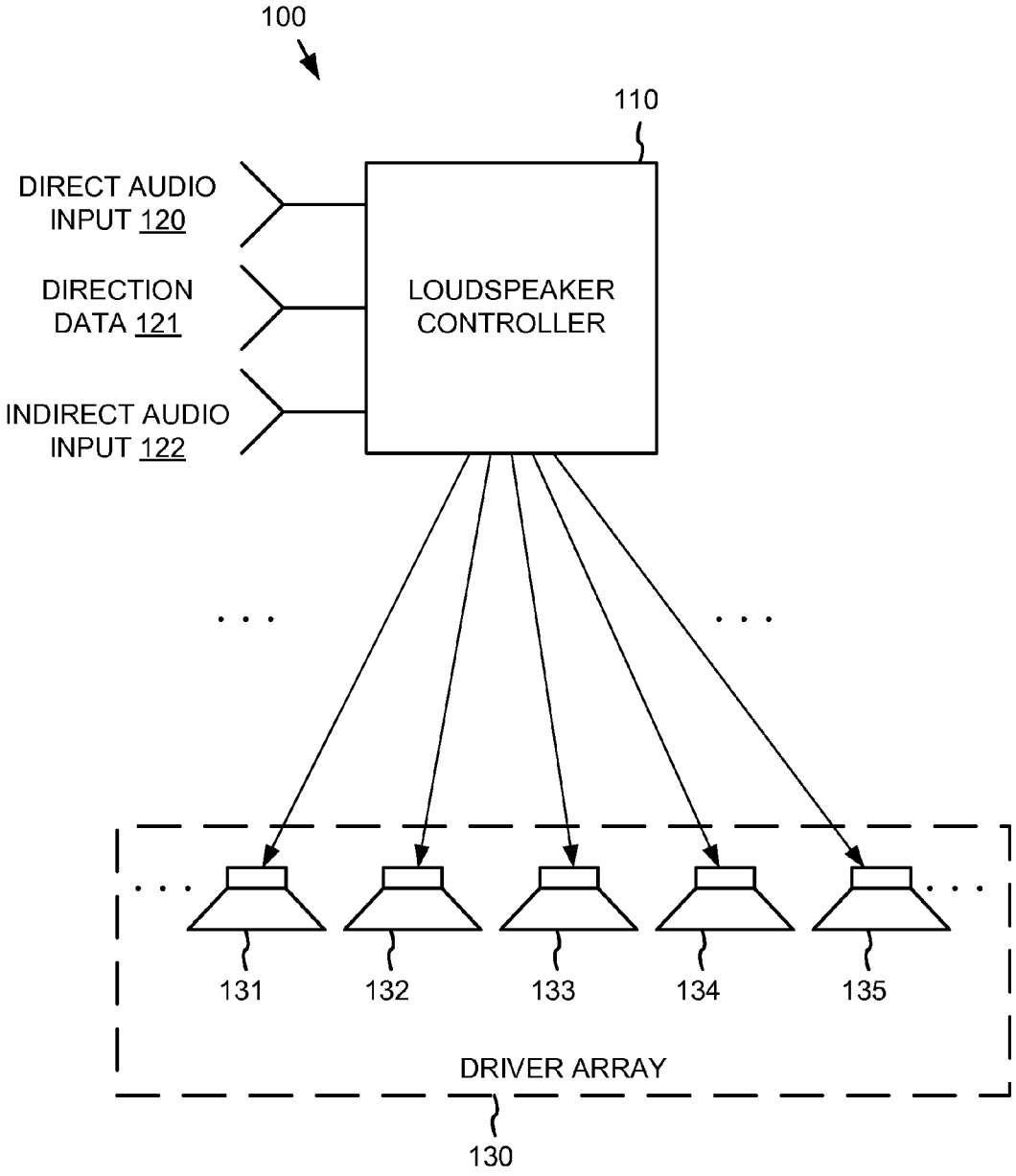
FIG. 1 is a schematic block diagram of an array loudspeaker providing direct and indirect sound radiation from a same set of drivers.

With reference to FIG. 1, one embodiment of an array loudspeaker for radiating direct and indirect sound from a same set of drivers includes digital signal processor (DSP)-based loudspeaker controller 110, and a plurality of drivers 131-135 arranged in a driver array 130. The array loudspeaker has inputs 120-122 for receiving a direct audio signal, direction parameter data, and an indirect audio signal. The loudspeaker controller 110 processes these inputs to produce the individual audio signals to radiate from each of the drivers 131-135 in the driver array. Based on the direction parameter data, the loudspeaker controller 110 modifies the phase, amplitude and delay of the direct audio signal applied to each individual driver of the driver array, so that the direct sound radiating from the drivers combine to form a directed beam or a planar or spherical wavefront from the loudspeaker. In addition, the loudspeaker controller also modifies the phase and amplitude of the indirect audio signal applied to each driver, so that the indirect sound radiating from the drivers have dithered delays and are substantially decorrelated in amplitude and envelope from each other. The combined effect of these decorrelated indirect sound signals radiating from the separate drivers of the driver array produces the perception of a diffuse sound field. In this way, the array loudspeaker can vary the ratio of direct and indirect sound that it radiates, and provides a more accurate sensation of diffuse, indirect sound.

The direct and indirect audio signals input to the array loudspeaker can originate in a variety of ways. For applications like computer video games, the game application can separately synthesize the audio signals from direct sources in the virtual game environment, as well as synthesize an indirect audio signal for the diffuse sound for the virtual space of the game environment. The direction parameter data likewise is calculated from the direct sound sources within the game environment.

For recorded sound, the direct and indirect audio signals can be produced by analyzing the stereo channels of a sound recording to identify perceptual soundfield imaging cues characteristic of direct sound, such as by applying an envelope detection analysis in critical bands as described by Johnston, U.S. Pat. No. 7,027,601. Further, the direct and indirect sound signals can be captured even more accurately at recording by using an arrangement of directional microphones, which may be a stereo pair or more preferably in some applications can be arranged on a sphere as described by Johnston et al., U.S. Pat. No. 6,845,163. Similarly, the direction parameter data for the direct sound is derived by analyzing the recorded microphone channels to identify direction from which the identified direct sound originated.

The driver array 130 of the array loudspeaker 100 includes a plurality of drivers arranged in an array configuration. Preferably, each of the drivers forming the array is identical in size, and enclosure. Further, due to the Nyquist principle, the center-to-center spacing of the drivers can be no more than one half of the shortest wavelength (highest frequency of sound) apart for the controller to be able to steer or control the direction of the direct sound beam or wavefront radiated from the array without aliasing effects. The spacing of drivers in the array therefore determines the maximum frequency of the direct sound radiation from the array loudspeaker. On the other hand, lower frequencies require more energy to produce with a given size of driver. The choice of driver size and spacing between drivers therefore practically limit the range of frequencies that can be produced by the array loudspeaker.

Figure 2:
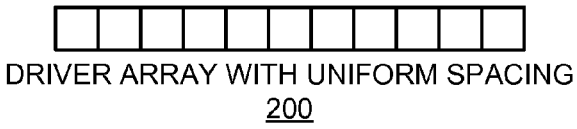
FIG. 2 is a block diagram illustrating an arrangement of the drivers in the array loudspeaker of FIG. 1 with uniform spacing.

In one embodiment, the drivers 131-135 forming the driver array 130 are arranged in a uniform spacing configuration as illustrated in FIG. 2. However, this uniform spacing configuration has a comparatively narrow bandwidth (ratio of highest to lowest frequency that can be dealt with by the driver array). In general, the bandwidth of a uniformly spaced driver array is approximately $(N-1)/2$ for an array of N drivers. Accordingly, a very large number of drivers would be required to radiate the wide range of frequencies audible to the human ear.

Figure 3:
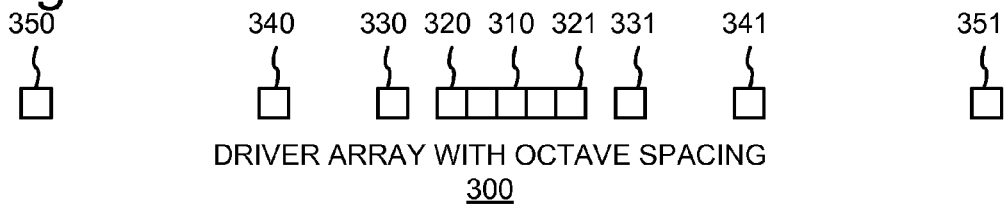
FIG. 3 is a block diagram illustrating an octave array arrangement of the drivers in the array loudspeaker of FIG. 1.

In a more preferred embodiment, the drivers 131-135 that form the driver array 130 are instead arranged with octave array spacing as illustrated in FIG. 3. With octave array spacing, the array comprises superimposed subsets of a number M of uniformly spaced speakers, where the driver spacing doubles between each successive subset. In the illustrated octave array for example, a subset of 5 elements forming the center of the array has the closest spacing. Successive subsets of 5 elements are then formed by adding two additional elements at twice the spacing of the previous subset, which in combination with the center element and two end elements of the previous subset form a 5 element subset at double the spacing of the previous subset. In the illustrated array, the closest spaced subset includes the 5 drivers at the center of the array between end elements 320 and 321. The next closest spaced subset is formed by the addition of two more elements 330-331 with twice the inter-element spacing, and includes the two additional elements 330-331 along with the end elements 320-321 of the previous subset and center element 310. As can be seen, this second subset has twice the spacing between elements as the 5 elements in the first subset. Similarly, a next subset with twice again the element spacing is formed with additional elements 340-341 in combination with the prior subset's end elements 330-331 and center element 310. The further 5 element subset is formed by adding elements 350-351 in combination with the end elements 340-341 of the preceding subset and center element 310. In other embodiments, the number of elements per subset and number of subsets can be varied. An even number of elements per subset can be used. However, the driver array 130 preferably uses an octave array configuration using an odd number of elements per octave subset, so as to provide a center element.

With the octave array configuration, each separate uniformly spaced subset of drivers can be used for a different range or band of frequencies. For example, the drivers forming the center 5 elements of the illustrated octave array are used for the highest frequency band, while successive more widely spaced subsets are used for successively lower frequency bands (the maximum frequency of each band being half the maximum frequency of the previous band). In this way, the driver array 130 with octave array configuration 300 is able to cover a much broader range of frequencies using fewer drivers compared to the uniformly spaced array. In general, the octave array configuration achieves a bandwidth of approximately 2^((N−1)/2), for N elements. For an example array having 11 elements (such as that illustrated in FIG. 3), the octave array configuration 300 has a bandwidth of approximately 32 compared to a bandwidth of 5 for the uniformly-spaced array configuration 200.

One suitable choice of driver size is to use an array of one-inch diameter drivers. Allowing for enclosure walls separating the driver enclosures in the array, this choice of driver size permits a closest center-to-center driver spacing of approximately one and one third inches, which allows for a maximum high frequency of approximately 10 kHz. However, depending on the desired application, a smaller or larger driver size can be chosen to provide a different maximum frequency of the direct sound beam or wavefront. With only 11-elements in an octave array configuration for example, the driver array using this driver size can radiate sound over a frequency range of less than 500 Hz to over 10 kHz.

Although the driver array 130 in the above embodiments has drivers configured as a linear array in a single dimension, alternative implementations can use non-linear arrangements of the drivers (e.g., on a curve), such as to aid in creating a spherical wavefront for the directional sound. Additionally, alternative embodiments can use a two dimensional arrangement of the drivers. For example, the array loudspeaker can include a second octave array at a perpendicular angle to the first octave array (or alternatively two or more additional octave arrays offset at uniform or non-uniform angles from a first, horizontal octave array).

Figure 4:
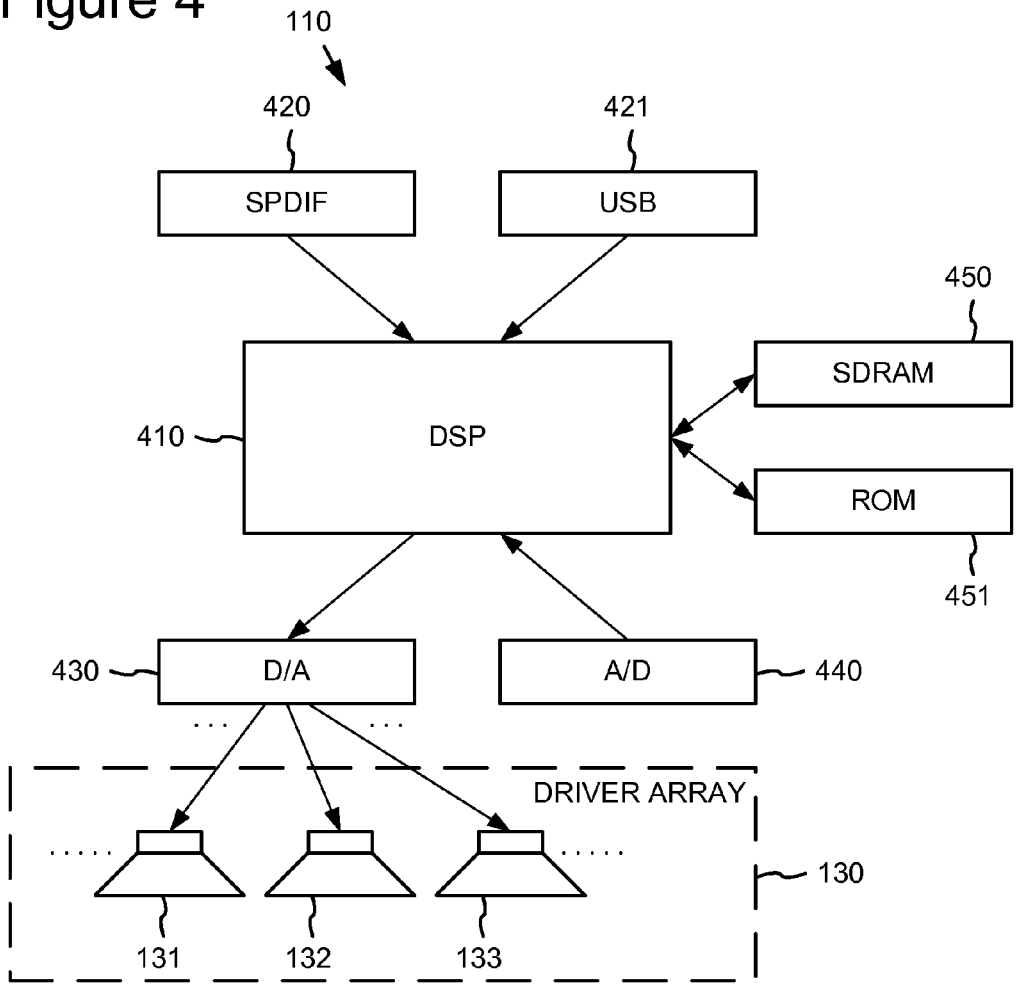
FIG. 4 is a block diagram illustrating digital signal processing hardware in the array loudspeaker of FIG. 1.

FIG. 4 shows an implementation of the loudspeaker controller 110 (FIG. 1) in more detail. The loudspeaker controller can be housed in a separate audio component, such as in a rack unit that may be mounted in an audio component rack. Alternatively, the loudspeaker controller can be implemented on a circuit board housed together with the driver array 130 in a single housing.

The loudspeaker controller 110 includes a digital signal processor (DSP) 410 for processing the direct and indirect audio signal inputs 120-122 to produce output audio signals for each of the drivers 131-133 in the driver array 130. The illustrated implementation of the loudspeaker controller includes various interfaces that can act as the audio and direction data inputs 120-122, including a digital audio interface 420 (such as, a SPDIF (Sony/Philips Digital Interface Format) format interface), a serial data interface 421 (such as, a universal serial bus (USB) interface), and an analog-to-digital converter 440. Alternative implementations of the loudspeaker controller can provide only analog audio inputs, only digital audio inputs, or both digital and analog inputs. Further, alternative loudspeaker controller implementations can use various other interface formats or standards.

The loudspeaker controller 110 also includes random access memory (RAM) 450 and read only memory (ROM) 451. The ROM 451 stores firmware and audio processing instructions for the digital signal processor. The RAM 450 is used by the digital signal processor 410 for temporary storage of data during audio processing. The RAM 450 in the illustrated embodiment is a synchronous dynamic random access memory (SDRAM), although other memory technologies alternatively can be used.

The loudspeaker controller 110 further includes a bank of digital-to-analog converters for producing the audio signal outputs to the individual drivers 131-133 of the driver array 130. In one implementation, the loudspeaker controller has 16 channels of digital-to-analog converter outputs, which is sufficient to provide the output channels for a driver array configured as the eleven element octave array illustrated in FIG. 3. The remaining digital-to-analog converter output channels can be used to provide audio signal outputs for a sub-woofer or like low frequency driver to further extend the low end of the frequency range of the loudspeaker, or may go unused.

Figure 5:
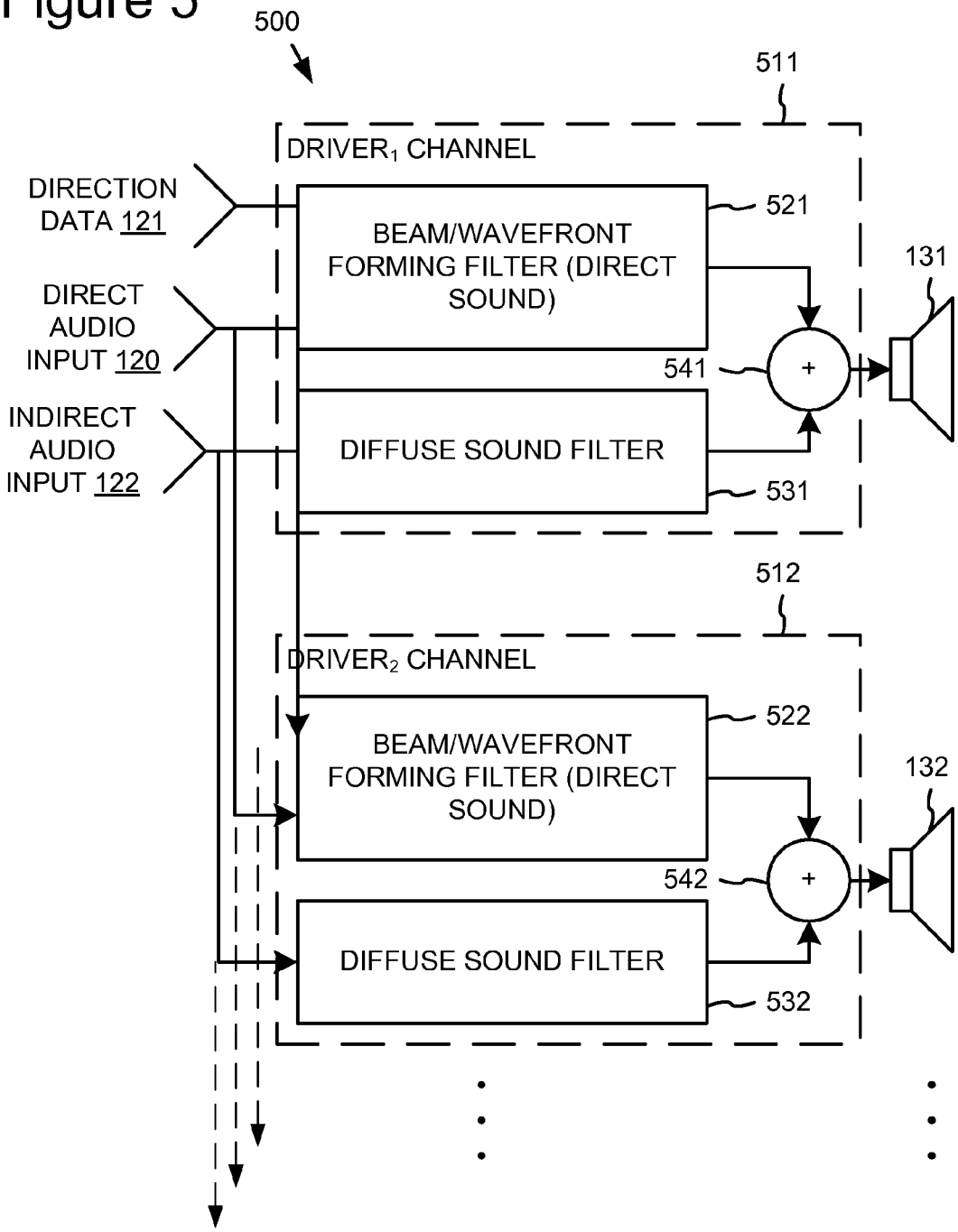
FIG. 5 is a data flow diagram illustrating processing of audio signal inputs by the digital signal processing hardware of FIG. 4 to produce direct and indirect sound radiating from the drivers in the array loudspeaker of FIG. 1.

FIG. 5 generally illustrates the signal processing 500 of the direct audio input, direction parameter data, and indirect audio input by the digital signal processor 410 of the loudspeaker controller 110 to produce the audio signal outputs to the individual drivers of the driver array. As discussed above, the array loudspeaker 100 can operate to create any combination of a directed beam, a spherical wavefront, and diffuse sound. The array loudspeaker thus can simultaneously radiate a directed beam in a particular direction into the listening area, direct a beam as a spherical wavefront generally at the whole room, and provide a diffuse, enveloping sound ambience. The indirect sound is radiated from the drivers of the driver array as an indirect pattern that reduces time waveform and envelope correlation, which better simulates a sensation of a diffuse soundfield for the listener. Further, the loudspeaker array is able to vary the ratio of the direct sound and indirect sound that it radiates into the room, so as to better overlay desired playback acoustics (e.g., simulating acoustics of a famous concert hall) on the actual listening space (e.g., a media room in the home).

The digital signal processor 410 creates a directed beam or spherical wavefront by modifying the phase, amplitude and/or delay of the direct audio signal on individual driver output channels 511-512 using a set of beam/wavefront-forming filters 521-522, which may be implemented in the digital signal processor programming as digital all-pass finite impulse response (FIR) filters. Although only two driver channels 511-512 are shown in FIG. 5 for ease of illustration, the digital signal processor provides a separate driver channel for each individual driver of the array. In the case of direct sound beam, the digital signal processor processes the direct sound signal applying known beam-forming techniques to produce the individual driver outputs. The phase and amplitude of the direct audio signal output to the individual drivers is modified so that the audio from the various speakers combines or correlates as a beam in the direction characterized by the direction parameter data, as per known beam-forming techniques in the art. In this way, the beam can be steered within an arc of approximately 95-100 degrees in front of the array loudspeaker. For example, the beam-forming operation can delay the direct audio signal output to left side drivers relative to the direct audio signal output to drivers on the right side of the array to steer a beam to the left. In the case of a direct sound wavefront directed generally at the listening space, the direct sound can be progressively delayed towards the sides of the array relative to that output by the center driver so as to create a beam directed generally into the listening area as a spherical wavefront.

In some embodiments, the array loudspeaker can operate to create a pseudo-constant sound beamwidth by radiating sound from all drivers of the driver array at low frequencies and progressively fewer drivers at higher frequency ranges. For a given size driver, the intensity of sound produced by the driver diminishes as the frequency of the audio signal goes lower. In other words, a progressively higher power signal would be required to produce the same sound intensity at a progressively lower frequency with the same driver. The loudspeaker array can compensate for this effect by radiating the signal from more drivers of the array at its lowest frequencies, and using progressively fewer drivers at higher frequencies so as to produce a pseudo-constant beamwidth. For example, as described above for the octave array configuration 300 (FIG. 3), the most closely spaced subset of drivers is used to produce directed sound beams in the highest frequency band, while successively lower frequency bands of the directed beam are produced from successively wider spaced subsets of the drivers. In the example illustrated above, five drivers are used in each band. Instead of using the same number of drivers in each frequency band, the array loudspeaker uses all drivers in its low frequency band, and fewer drivers at high frequencies. In one implementation, the high frequency band uses the five closely spaced center drivers, and each successive lower frequency octave band adds two additional more widely spaced drivers.

In addition to creating a directed beam and/or wavefront, the array loudspeaker 100 can simultaneously create diffuse sound output based on the separate indirect sound input, and can vary the ratio of direct to indirect sound in a way that more accurately simulates an overlay of a desired soundfield on the listening space. The loudspeaker controller 110 creates a diffuse sound field using digital signal processing to modify the phase and amplitude of the indirect sound signal such that the pattern of the indirect sounds has reduced time waveform and envelope correlation. In one implementation, the digital signal processor use a set of digital filters 531-532 to modify the phase and amplitude of the indirect sound signal for each of the individual driver channels 511-512. These filters also can be implemented as all-pass, finite impulse response filters. The filters 511-512 dither the delay of the indirect signal in the driver channels, so that the indirect signal radiated by each individual driver is different from the direct signal radiated from all other drivers. In one embodiment, each driver channel is assigned a different prime number, and the indirect audio signal is delayed in relation to the prime number assigned to the driver channel. The prime numbers assigned to the driver channels are chosen so that the indirect audio signal delay is on average the same across the drivers. This radiates the indirect audio signal from the driver array in a pattern with reduced time waveform and envelope correlation creating a sensation of diffuse sound for the listener.

Finally, for each driver channel 511-512, the digital signal processor 410 sums the direct audio signal and indirect audio signal as shown by summation blocks 541-542 to produce the audio output radiated by the individual drivers 131-132 of the array.

In view of the many possible embodiments to which the principles of our invention may be applied, we claim as our invention all such embodiments as may come within the scope and spirit of the following claims and equivalents thereto.

We claim:

1. A loudspeaker for an audio sound system, comprising:

a direct audio input configured to receive a first audio signal to be radiated from the loudspeaker as direct sound;

an indirect audio input configured to receive a second audio signal to be radiated from the loudspeaker as indirect sound, wherein the first and second audio signals are generated independently from a common signal;

a direction parameter input configured to receive direction parameters characterizing a direction in which the direct sound is to be radiated, the direction established by modifying the phase, amplitude and delay of the first audio signal using the direction parameters;

a driver array having a plurality of drivers arranged along at least a first spatial dimension; and a digital signal processor-based controller configured to:

establish the first audio signal and the second audio signal based on a recorded audio signal;

process the first audio signal in accordance with the direction parameters so as to produce a plurality of direct audio signals so as to radiate sound in the direction characterized by the direction parameters; and process the second audio signal so as to produce and radiate as indirect sound audio amplitude and envelope, spatially decorrelated signals coupled to individual drivers in the array, the indirect sound being with reduced spatial correlation.

2. The loudspeaker of claim 1, wherein the drivers of said plurality of drivers are arranged along the first spatial dimension to have uniform center-to-center spacing.

3. The loudspeaker of claim 1, wherein said plurality of drivers is arranged along the first spatial dimension with octave array spacing.

4. The loudspeaker of claim 1, wherein said controller is coupled so as to use a larger number of said drivers to output a low frequency range portion of the sound and a smaller number of said drivers to output a high frequency range portion of the sound.

5. The loudspeaker of claim 1, wherein said controller uses all of said drivers to output the low frequency range portion of the sound, and successively smaller subsets of said drivers to radiate higher frequency range portions to create a pseudo-constant beamwidth of sound.

6. The loudspeaker of claim 1, wherein said controller processes the first audio signal in a beam-forming operation to produce audio signal outputs from said drivers that produce a directed beam in the direction characterized by the direction parameters.

7. The loudspeaker of claim 1, wherein said controller processes the first audio signal in a spherical wavefront forming operation to produce audio signal outputs from said drivers that produce a spherical wavefront from the loudspeaker directed in the direction characterized by the direction parameters.

8. The loudspeaker of claim 1, wherein the digital signal processor-based controller includes digital filters associated with respective individual drivers in the array, wherein the digital filters are configured to dither the delays of the audio amplitude and envelope spatially decorrelated signals so that indirect sound radiated by each individual driver is different from the direct audio signal radiated from all other drivers.

9. The loudspeaker of claim 1, wherein and the digital signal processor-based controller is configured to delay the audio amplitude and envelope spatially decorrelated signals based on a prime number assigned to a respective individual driver.

10. The loudspeaker of claim 1, wherein the digital signal processor-based controller is configured to receive the recorded audio signal from a random access memory.

11. The loudspeaker of claim 1, wherein the digital signal processor-based controller is configured to:

provide a separate driver channel for each driver in the array; and vary a ratio of the first audio signal to the second audio signal based on a desired playback acoustic characteristic.

12. The loudspeaker of claim 1, wherein the digital signal processor-based controller is configured to:

generate the first audio signal and the second audio signal based on one or more sound field imaging characteristics of the direct sound; and determine one or more of the direction parameters by analyzing recorded microphone channels associated with the direct sound.

13. A method of controlling an array loudspeaker to provide direct and indirect sound, the array loudspeaker having a set of drivers arranged as an array along a first spatial dimension, the method comprising:

processing a recorded audio signal to obtain a first audio signal associated with direct sound and a second audio signal associated with diffuse sound, wherein the first and second audio signals are generated independently from a common signal;

processing the first audio signal based on a set of direction parameters to produce direct audio signals, and coupling the direct audio signals to respective drivers of the set of drivers to produce direct sound outputs, wherein the processing includes modifying the phase, amplitude and delay of the first audio signal using the direction parameters;

processing the second audio signal to produce and radiate as indirect sound output amplitude and envelope spatially decorrelated audio signals having reduced wavefront and envelope correlation, wherein the producing comprises coupling the amplitude and envelope spatially decorrelated audio signals to one or more drivers of the set of drivers;

combining the direct sound output and indirect sound output; and outputting the combined direct and indirect sound outputs from the set of drivers to simultaneously radiate direct and indirect sound using the same drivers.

14. The method of claim 13, wherein said processing the first audio signal comprises performing a beam forming operation to produce a direct sound beam in the direction specified by the direction parameters.

15. The method of claim 13, wherein said processing the first audio signal comprises modifying the amplitude and phase of the direct sound outputs to individual drivers so as to radiate the direct sound as a spherical wavefront from the drivers.

16. The method of claim 13, wherein said processing the second audio signal comprises dithering delays of the indirect sound outputs to individual drivers.

* * * * *